US010919142B2

(12) United States Patent
Hsieh

(10) Patent No.: US 10,919,142 B2
(45) Date of Patent: Feb. 16, 2021

(54) RAIL TYPE TOOL RACK

(71) Applicant: Chih-Chien Hsieh, Taichung (TW)

(72) Inventor: Chih-Chien Hsieh, Taichung (TW)

( * ) Notice: Subject to any disclaimer, the term of this patent is extended or adjusted under 35 U.S.C. 154(b) by 0 days.

(21) Appl. No.: 16/898,986

(22) Filed: Jun. 11, 2020

(65) Prior Publication Data

US 2020/0406447 A1 Dec. 31, 2020

(30) Foreign Application Priority Data

Jun. 27, 2019 (TW) ..... 108122578 A

(51) Int. Cl.
*B25H 3/04* (2006.01)

(52) U.S. Cl.
CPC ..... *B25H 3/04* (2013.01)

(58) Field of Classification Search
CPC .. B25H 3/04; B25H 3/003; B25H 3/06; B25B 13/56; B25B 13/06
See application file for complete search history.

(56) References Cited

U.S. PATENT DOCUMENTS 4,320,935 A * 3/1982 Nagelkirk ..... A47B 95/008 312/350
5,967,340 A * 10/1999 Kao ..... B25H 3/04 206/493
6,431,373 B1 * 8/2002 Blick ..... B25H 3/003 206/378
6,626,402 B1 * 9/2003 Kaminstein ..... A46B 17/02 211/70.6
6,698,603 B2 * 3/2004 Lawson ..... A47F 5/0846 211/94.01
7,137,515 B1 * 11/2006 Lawson ..... A47G 25/0692 211/85.3
9,126,329 B2 * 9/2015 Kao ..... F16M 13/022
9,186,790 B1 * 11/2015 Kao ..... B25H 3/003
9,375,836 B2 * 6/2016 Su ..... B25H 3/04
9,527,206 B1 * 12/2016 Hsieh ..... B25H 3/04
9,545,716 B2 * 1/2017 Hsieh ..... B25H 3/04
D785,429 S * 5/2017 Hsieh ..... D8/71
D813,638 S * 3/2018 Hsieh ..... D8/71
9,962,827 B2 * 5/2018 Kao ..... B25H 3/04
10,130,194 B1 * 11/2018 Lai ..... B65G 1/10
10,589,416 B1 * 3/2020 Hsieh ..... B25H 3/04
10,603,785 B1 * 3/2020 Hsieh ..... B25H 3/003
2006/0234846 A1 * 10/2006 Tucker ..... B25H 3/04 483/26

(Continued)

*Primary Examiner* — Patrick D Hawn
(74) *Attorney, Agent, or Firm* — Egbert Law Offices, PLLC

(57) ABSTRACT

Disclosed is a tool rack having a track, at least one tool positioning seat and two combined end covers. The track has an intermediate plate, two lateral grooves and two ends. Each lateral groove forms two side wall edges and one side opening, and the intermediate plate is respectively provided with a through hole at a position adjacent to each end. Each combined end cover includes a main body, one end limit block, two side claws and a bump. The main body has two lateral sides and one end side, and an abutting surface used for abutting against an outer wall surface of one side wall edge of the track. The end limit block abuts on the end of the track. The two side claws are respectively gripped and positioned outside the side wall edge of the track, and the bump is embedded in the through hole.

4 Claims, 4 Drawing Sheets

(56) References Cited

U.S. PATENT DOCUMENTS

| | | | | |
|---|---|---|---|---|
| 2010/0295748 | A1* | 11/2010 | Bradley | H01Q 1/42 343/872 |
| 2014/0209780 | A1* | 7/2014 | Chang | F16M 13/005 248/551 |
| 2015/0034518 | A1* | 2/2015 | Kao | B25H 3/04 206/372 |
| 2015/0122750 | A1* | 5/2015 | Kao | B25B 13/06 211/13.1 |
| 2015/0151428 | A1* | 6/2015 | Su | B25H 3/04 403/361 |
| 2015/0336262 | A1* | 11/2015 | Kao | B25H 3/003 206/378 |
| 2016/0221178 | A1* | 8/2016 | Hsieh | B25F 1/04 |
| 2016/0271788 | A1* | 9/2016 | Hsieh | B25H 3/04 |

* cited by examiner

RAIL TYPE TOOL RACK

CROSS-REFERENCE TO RELATED U.S. APPLICATIONS

Not applicable.

STATEMENT REGARDING FEDERALLY SPONSORED RESEARCH OR DEVELOPMENT

Not applicable.

NAMES OF PARTIES TO A JOINT RESEARCH AGREEMENT

Not applicable.

REFERENCE TO AN APPENDIX SUBMITTED ON COMPACT DISC

Not applicable.

BACKGROUND OF THE INVENTION

1. Field of the Invention

The present invention relates generally to a rack for tools, and more particularly to the innovative structure type of a rail type tool rack.

2. Description of Related Art Including Information Disclosed Under 37 CFR 1.97 and 37 CFR 1.98

Said rail type tool rack is generally used as a holder for placing such tools as sleeves and screwdrivers. Its structure design is characterized by a long extended railroad shoe, and the railroad shoe is provided with an embedded slideway for slideable adjustment of several tool positioning seats, and the two opposite ends of railroad shoe are usually provided with end covers to close the two ends of railroad shoe, and to restrain the tool positioning seat.

The end covers of early rail type tool racks were usually fixed, thus, in practical use, the users could not increase or reduce or change the tool positioning seat, which was inconvenient. Afterwards, related circles developed some combined end cover types accordingly.

There are several types of the known structure of said combined end cover, but there are still some problems in practical application. For example, one of the known combined end covers is inserted in the socket formed at the end of railroad shoe and fixed by adhesives. The problem in this known type is that the combined end cover is fixed and nonremovable, causing inconvenience in the future. Another known combined end cover uses an elastic buckle block, the elastic buckle block is embedded in a slot opening in the seat surface of railroad shoe when the combined end cover is in combined state, and there is a release press button adjacent to the elastic buckle block, so that the user can disengage the elastic buckle block from the slot opening by pressing the release press button, and the combined end cover can be disengaged from the railroad shoe. However, this known combined end cover is complained for that the release press button is usually located in a relatively large region of end cover for convenient operation, but this position is usually the area of rail type tool rack gripped by the user's hand, it is likely to be pressed by accident to release the end cover by mistake. In practical application of the rail type tool rack, the user is little probably to disassemble or assemble the combined end cover. Therefore, the probability of said releasing the end cover by mistake induced by pressing the release press button by accident is too high, increasing the user's concerns in vain.

BRIEF SUMMARY OF THE INVENTION

The primary object of the present invention is to provide a rail type tool rack, the technical problem to be solved is to break through how to develop a novel rail type tool rack with more ideal practicability, the combined end cover thereof can be assembled and combined easily.

Based on said object, the technical characteristic of problem solving of the present invention is that the rail type tool rack comprises a track, at least one tool positioning seat and two combined end covers, each tool positioning seat is provided with two gripping legs arranged symmetrically. The track is a long extended type, comprising an intermediate plate, two lateral grooves and two ends symmetrically connected to two opposite sides of intermediate plate. The lateral grooves are oppositely defined to form two side wall edges arranged vertically and a side opening between the outer sides of two side wall edges, and the two gripping legs of each tool positioning seat grip the outer side of the corresponding side wall edge, there is a through hole near each end of intermediate plate, penetrating the thickness of intermediate plate. Each combined end cover comprises a main body, an end limit block, two side claws and a bump. The main body comprises an abutting surface, two lateral sides and one end side. The abutting surface abuts against the outer wall surface of a side wall edge of the track. The end limit block is a block protruding downwards near the end side from the abutting surface, and the end limit block abuts on the corresponding end of track. The two side claws are two elastic undercuts protruding downwards near the two lateral sides from the abutting surface, and the two side claws grip the outer side of the corresponding side wall edge of track respectively. The bump is a block protruding downwards in the position between two side claws from the abutting surface, and the bump is embedded in the corresponding through hole of the intermediate plate for the track.

In terms of main effects and advantages of the present invention, with the specific architecture of the rail with an intermediate plate and two lateral grooves oppositely defined to form two side wall edges and a side opening, a combined end cover structure type convenient for assembling with excellent stability in combined state is provided. When said combined end cover is combined with the end of track, the two side claws of combined end cover grip the outer sides of side wall edges of track respectively. The bump is embedded in the through hole of intermediate plate of track. The end limit block hooks the track end, so that the combined end cover in combined state can be positioned in X, Y and Z directions, resulting in excellent firmness in combined state, preventing arbitrary drop-off. To assemble the combined end cover in the track end, as the side claws and end limit block have moderate ductility, the combination can be finished quickly as long as the user applies a little force.

Another object of the present invention is to provide another technical feature that a chamfer angle is provided on each side edge of the downward protruding end of the bump, so as to achieve the advantage and practical progressiveness that the bump can be easily stuck in the through hole of intermediate plate based on the morphological feature of chamfer angle.

Another object of the present invention is to provide another technical feature as the thickness of the intermediate plate defines a first thickness, a second thickness is defined between the outer wall surfaces of the two side wall edges, the second thickness is larger than the first thickness, so that the intermediate plate surface is a concave surface in relation to the outer wall surfaces of two side wall edges, and the thickness of intermediate plate is smaller than the thickness formed by the outer wall surfaces of two side wall edges, so as to achieve such advantages and practical progressiveness as material removal, equal thickness and saving material cost.

Another object of the present invention is to provide another technical feature as the end limit block is provided with two stilts arranged apart for connecting the abutting surface, a hollow part is formed between two stilts, the hooking width of end limit block coordinates with the width of intermediate plate, so that the end limit block has such advantages as wide firmness, material removal and saving material cost, and the end limit block exactly hooks the concave intermediate plate, further enhancing the firmness of hooking state.

DETAILED DESCRIPTION OF THE INVENTION

Figure 1:
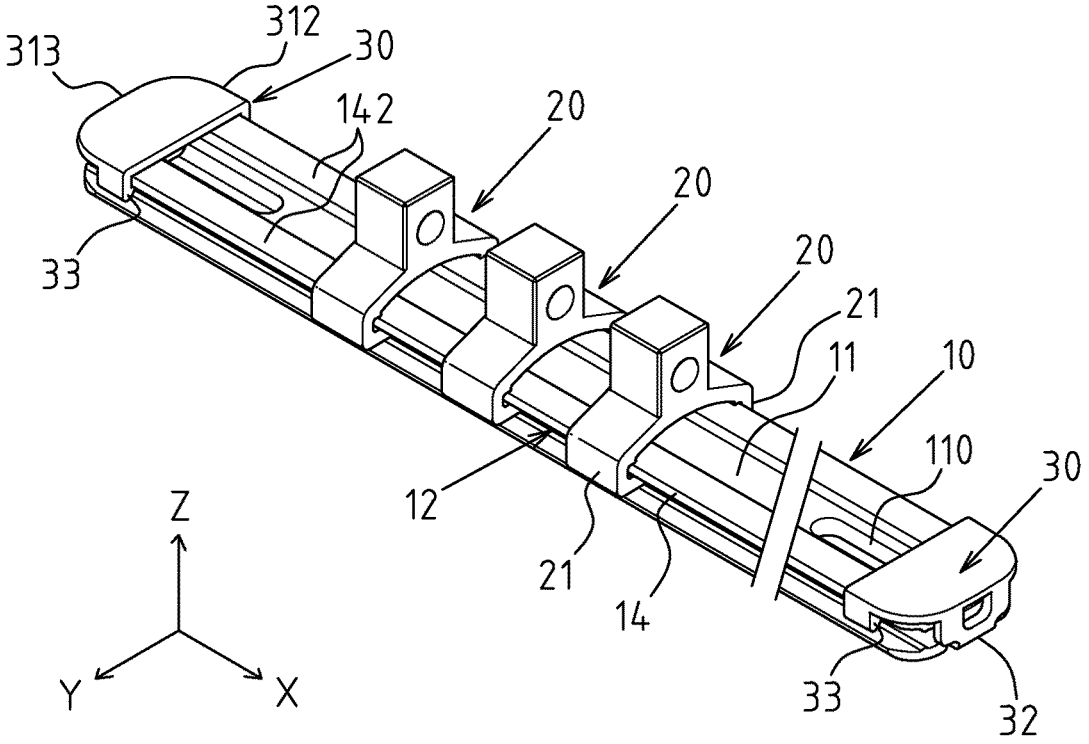
FIG. 1 is the combined stereogram of the preferred embodiment of the present invention.
Figure 2:
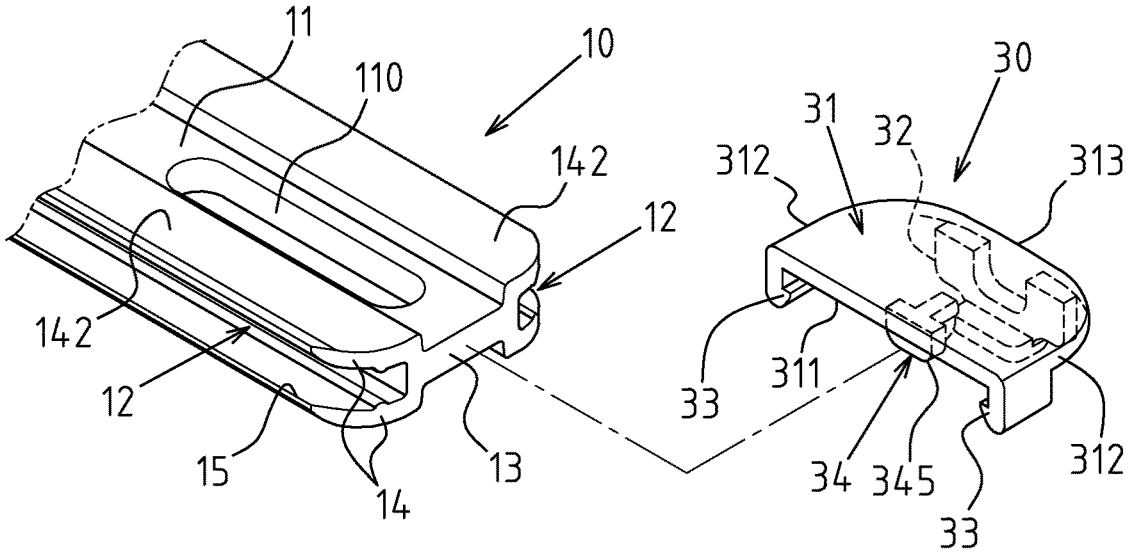
FIG. 2 is the exploded view of partial components in the preferred embodiment of the present invention.

FIGS. 1 to 6 show the preferred embodiments of the rail type tool rack of the present invention, but the embodiments are for illustration only, the patent application is not limited to this structure.

Said rail type tool rack A comprises a track 10 (can be but not limited to aluminum product extrusion molding), at least one tool positioning seat 20 (plastic material is preferred) and two combined end covers 30 (plastic material is preferred). The tool positioning seat 20 is provided with two gripping legs 21 arranged symmetrically; wherein the track 10 is long extended type, comprising an intermediate plate 11, two lateral grooves 12 symmetrically connected to two opposite sides of the intermediate plate 11 and two ends 13. The lateral grooves 12 are oppositely defined to form two side wall edges 14 arranged vertically and a side opening 15 between the outer sides of the two side wall edges 14, and the two gripping legs 21 of the tool positioning seat 20 hook the outer side of the corresponding side wall edge 14, and there is a through hole 110 near each end 13 of the intermediate plate 11, penetrating the thickness of the intermediate plate 11. Wherein the combined end cover 30 comprises a main body 31, an end limit block 32, two side claws 33 and a bump 34. The main body 31 comprises an abutting surface 311, two lateral sides 312 and one end side 313. The abutting surface 311 abuts against the outer wall surface 142 of a side wall edge 14 of the track 10. The end limit block 32 is a block protruding downwards near the end side 313 from the abutting surface 311, and the end limit block 32 abuts on an end 13 of the track 10. The two side claws 33 are two elastic undercuts protruding downwards near the two lateral sides 312 from the abutting surface 311, and the two side claws 33 grip the outer side of the corresponding side wall edge 14 of the track 10. The bump 34 is a block protruding downwards in the position between the two side claws 33 from the abutting surface 311, and the bump 34 is embedded in the through hole 110 of intermediate plate 11 of the track 10.

Figure 3:
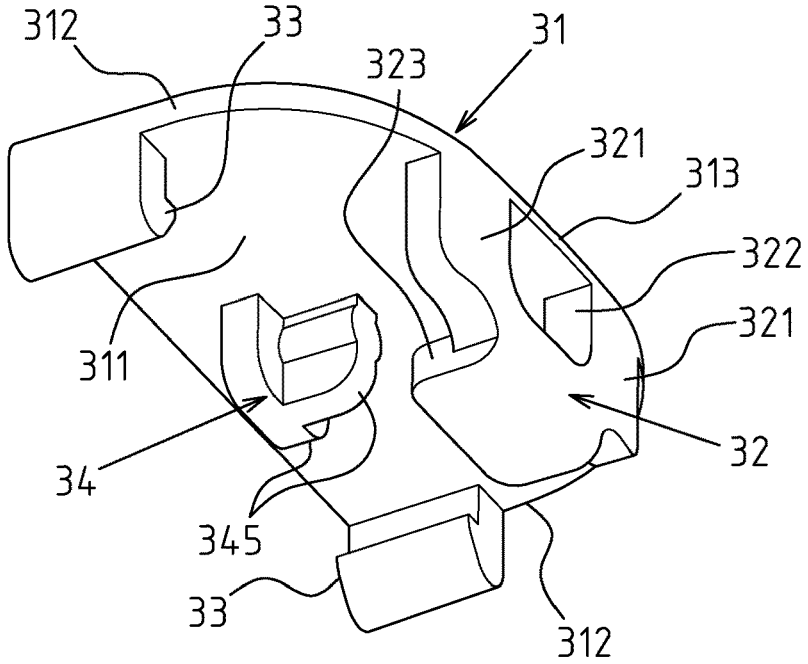
FIG. 3 is the stereogram from another view angle of the combined end cover of the present invention.
Figure 5:
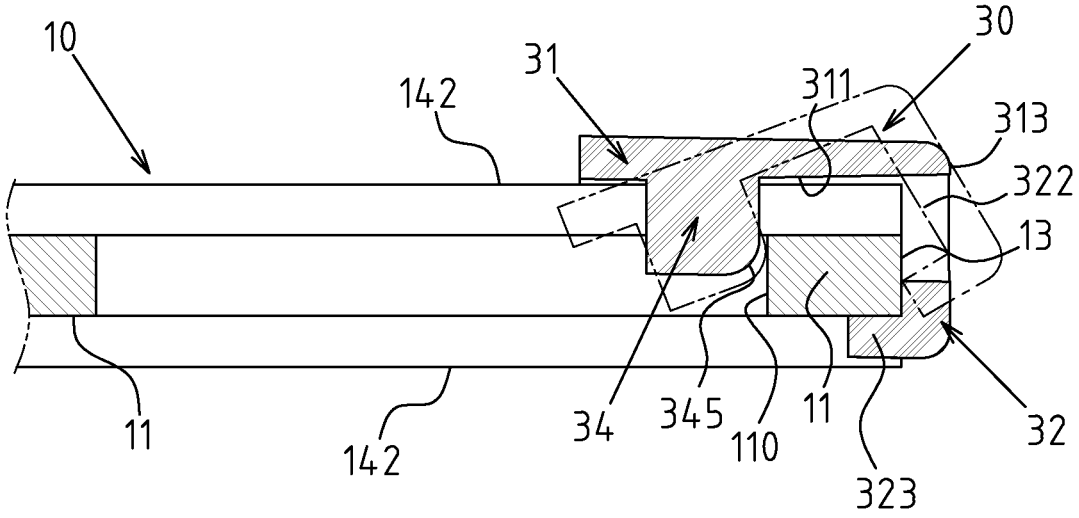
FIG. 5 is the 5-5 sectional view of FIG. 4.
Figure 7:
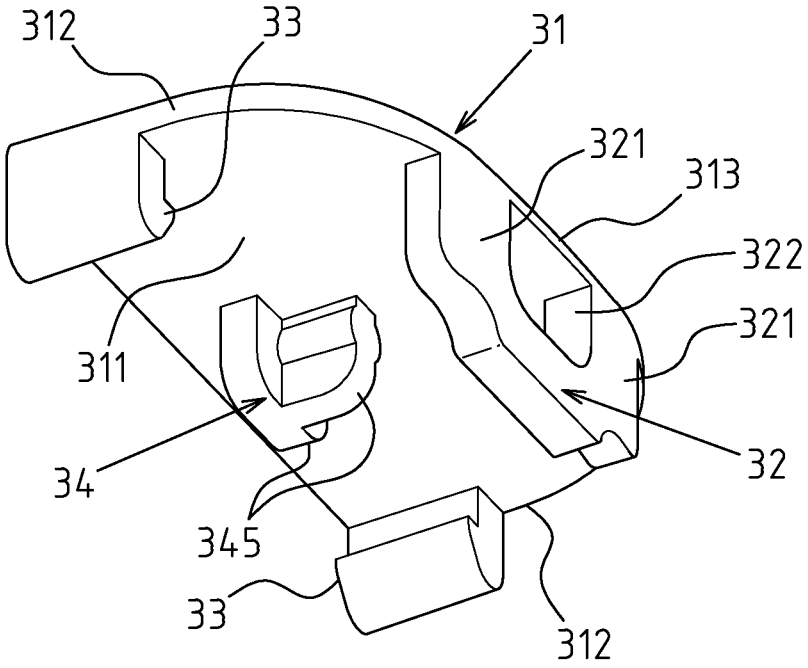
FIG. 7 shows another embodiment of the end limit block of the present invention.

As shown in FIG. 3, in this case, the downward protruding end of the end limit block 32 is provided with an undercut part 323, the undercut part 323 abuts against the corresponding part of the intermediate plate 11 (as shown in FIG. 5). In this case, the undercut part 323 creates the positioning effect of end limit block 32 in one more direction. The downward protruding end of the end limit block 32 without the undercut part 323 is shown in FIG. 7, which can be a specific implementation pattern.

Figure 4:
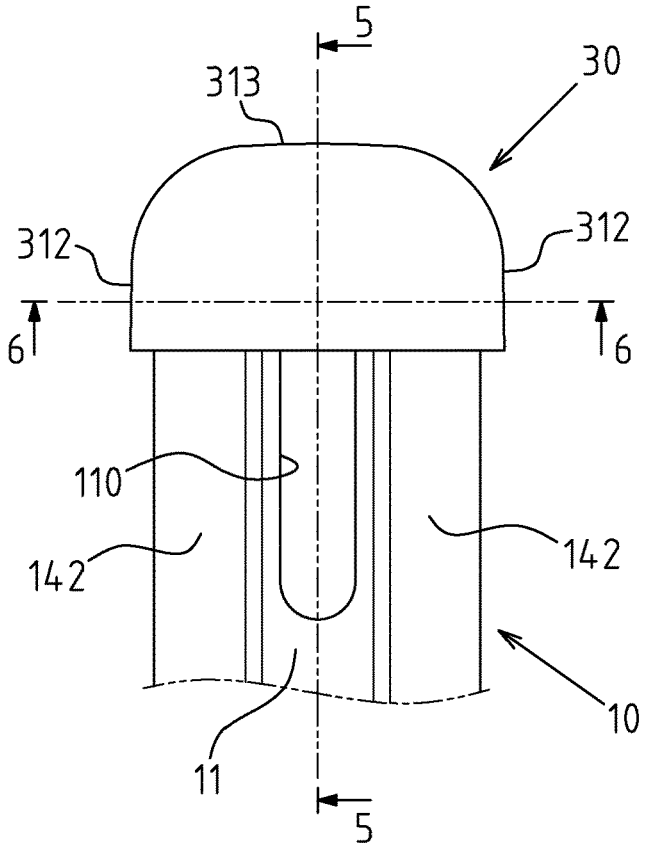
FIG. 4 is the top view of combined state of partial components in the preferred embodiment of the present invention.
Figure 6:
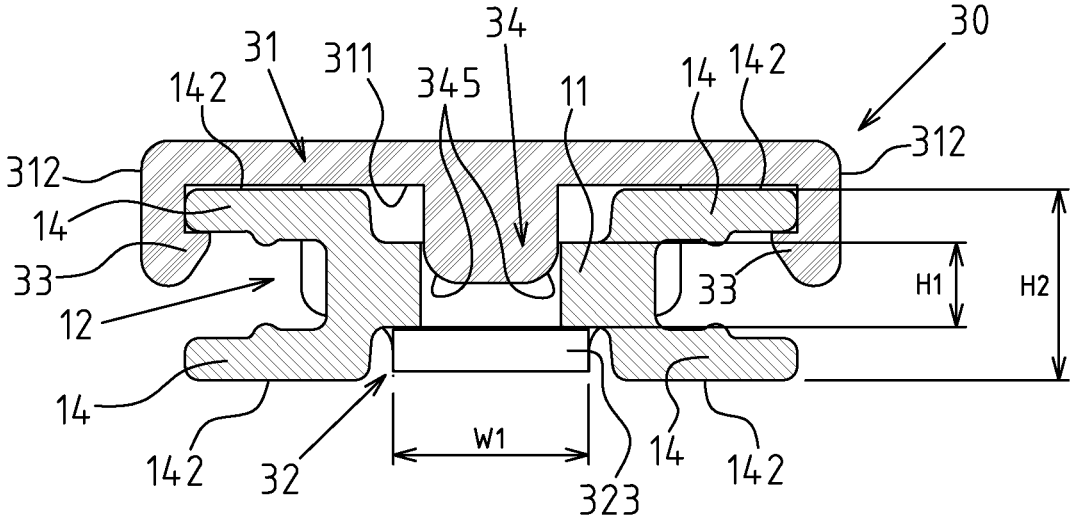
FIG. 6 is the 6-6 sectional view of FIG. 4.

Based on the aforesaid structural composition and technical characteristics, the rail type tool rack A disclosed in the present invention, in the specific morphological architecture of the track 10 with said intermediate plate 11, two lateral grooves 12 oppositely defined to form two side wall edges 14 and a side opening 15, a combined end cover 30 structure type convenient for assembling with extra firmness in combined state is provided. When said combined end cover 30 is combined with the end 13 of track 10, as shown in FIGS. 4 to 6 (note: please refer to the axis marks in FIG. 1 for description of axial direction), wherein the two side claws 33 of combined end cover 30 grip the outer sides of the corresponding side wall edges 14 of track 10 respectively, so as to implement positioning action in Y and Z directions. The bump 34 is embedded in the through hole 110 of intermediate plate 11 of track 10, this part implements the Y-axis positioning action. The end limit block 32 abuts on the end 13 of track 10, this part implements X-axis positioning action. To sum up, the combined end cover 30 of in the present invention combined with the end 13 of track 10 can implement the positioning actions in X, Y and Z directions, so it has extra firmness in combined state, the known problem of arbitrary drop-off of combined end cover 30 will not occur though the user's hand grips or presses the combined end cover 30. To assemble the combined end cover 30 in the end 13 of track 10, the bump 34 can be stuck in the through hole 110 of intermediate plate 11 of track 10, meanwhile as the side claws 33 and end limit block 32 have moderate ductility, the combination can be done quickly as long as the user applies a little force (Note: please refer to the variation between the construction line contour and solid line contour of combined end cover 30 disclosed in FIG. 5).

As shown in FIG. 3, in this case, the section of the bump 34 is T-shaped, and each side edge of the downward protruding end of the bump 34 is provided with a chamfer angle 345. The main effect of the implementation pattern disclosed in this case is to use the morphological feature of the chamfer angle 345 to make the bump 34 easier to be stuck in the through hole 110 of intermediate plate 11.

As shown in FIG. 6, in this case, the thickness of the intermediate plate 11 defines a first thickness H1, a second thickness H2 is defined between the outer wall surfaces 142 of the two side wall edges 14, wherein the second thickness H2 is larger than the first thickness H1, so that the surface of the intermediate plate 11 is a concave surface in relation to the outer wall surface 142 of the two side wall edges 14. The benefit of the implementation pattern disclosed in this case is that the thickness of intermediate plate 11 is smaller than the thickness formed by the outer wall surface 142 of two side wall edges 14, the advantages include material removal, equal thickness and saving material cost.

As shown in FIG. 3, in this case, the end limit block 32 is provided with two stilts 321 arranged apart for connecting the abutting surface 311, the two stilts 321 are oppositely defined to form a hollow part 322, as shown in FIG. 6, the hooking width of the end limit block 32 (W1) coordinates with the width of the intermediate plate 11. The benefit of the implementation pattern disclosed in this case is that the end limit block 32 has wide firmness, material removal and saving material cost, and the end limit block 32 exactly hooks the concave intermediate plate 11, further enhancing the firmness in hooking state (Note: increasing Y-axis positioning action).

I claim:

1. A tool rack assembly comprising:

an elongated track having an intermediate plate and a pair of lateral grooves and a pair of ends symmetrically connected respectively to opposite sides of the intermediate, plate, the pair of lateral grooves being oppositely defined to form a pair of side wall edges arranged vertically and to form a side opening between outer sides of the pair of side wall edges;

at least one tool positioning seat having a pair of gripping legs arranged symmetrically, wherein the pair of gripping legs hook the outer sides of the respective side wall edges of the pair of side wall edges, the intermediate plate having a through hole adjacent each of the pair of ends, the through hole extending through a thickness of the intermediate plate; and a pair of end covers, each of said pair of end covers comprising:

a main body having an abutting surface and a pair of lateral sides and an end side, wherein the abutting surface abuts against an outer wall of one of the pair of side wall edges of said track;

an end limit block protruding downwardly adjacent the end side from the abutting surface, said end limit block abutting one end of said track;

a pair of side claws being a pair of elastic undercuts protruding downwardly near the pair of lateral sides from the abutting surface, wherein said pair of side claws grip respectively the outer sides of the pair of side wall edges of said track; and a bump protruding downwardly between said pair of side claws, said bump being embedded in the through hole of the intermediate plate of said track, wherein said bump has a T-shaped cross-section, each side edge of a downward protruding end of said bump has a chamfer thereon.

2. The tool rack assembly of claim 1, wherein the thickness of the intermediate plate has a first thickness and a second thickness, the second thickness being defined between the outer wall surface of the pair of side wall edges, the second thickness being greater than the first thickness, wherein the intermediate plate has a concave surface relative to the outer wall surface of the pair of side wall edges.

3. The tool rack assembly of claim 2, wherein the downwardly protruding end of said end limit block has an undercut part, the undercut part abutting against a corresponding portion of the intermediate plate.

4. The tool rack assembly of claim 3, wherein said end limit block has a pair of stilts arranged in spaced relation so as to connect to the abutting surface, the pair of stilts defining a hollow part, wherein said end limit block has a hooking width that coordinates with a width of the intermediate plate.

* * * * *